US006193862B1

(12) United States Patent
Cutmore et al.

(10) Patent No.: US 6,193,862 B1
(45) Date of Patent: Feb. 27, 2001

(54) EDGE PROTECTOR STRIPS FOR ELECTROLYTIC-CELL ELECTRODES

(75) Inventors: John Parnell Cutmore; Rodger David Connolly, both of Queensland (AU)

(73) Assignee: Marley Plastics Pty Ltd., Victoria (AU)

( * ) Notice: Subject to any disclaimer, the term of this patent is extended or adjusted under 35 U.S.C. 154(b) by 0 days.

(21) Appl. No.: 09/245,961

(22) Filed: Feb. 5, 1999

(30) Foreign Application Priority Data

Feb. 5, 1998 (AU) ..... PP 1634

(51) Int. Cl.[7] ..... C25D 1/00
(52) U.S. Cl. ..... 204/281; 204/279
(58) Field of Search ..... 204/280, 281, 204/279

(56) References Cited

U.S. PATENT DOCUMENTS 4,406,769 * 9/1983 Berger ..... 204/281

* cited by examiner

*Primary Examiner*—Bruce F. Bell
(74) *Attorney, Agent, or Firm*—Morrison & Foerster LLP

(57) ABSTRACT

According to the invention, there is provided a protector strip (10) for an edge zone of an electrode plate (40), said protector strip (10) including a first channel shaped member (11) of relatively resilient material adapted, in use, to engage over the edge zone of the electrode plate, and a second channel shaped member (12) of relatively more rigid material separate to said first channel shaped member (11) adapted, in use, to engage over the first channel shaped member (11) to press at least a portion of said first channel shaped member (11) into sealing engagement with the edge zone of the electrode plate (40). There is also provided a protector strip (10) for an edge zone of an electrode plate (40), said protector strip (10) being formed by modular sections (28) adapted to be successively joined by a joint arrangement (29,30), each said modular section (28) having a channel shaped formation defining an inner groove (13) adapted in use to fit over the edge zone of the electrode plate (40), said joint arrangement (29,30) permitting one or more of said modular sections (28) to be removed and replaced without needing to replace all of the protector strip (10).

25 Claims, 6 Drawing Sheets

EDGE PROTECTOR STRIPS FOR ELECTROLYTIC-CELL ELECTRODES

The present invention relates to improvements to edge strip protection for electrode plates used electrolytic-cells typically for the production of non-ferrous metals by deposition thereon.

To simplify removal of deposited metal from the electrode plate after the deposition process, it is desirable to protect the side and bottom edges of the plate with edge strip protectors. The edge strip protectors may be plastics material strip mouldings or wax coatings or a combination of both to prevent the build up of deposited metal on the edge portions of the electrode plate. This ultimately assists with removal of the deposited metal from the electrode plates.

U.S. Pat. No. 4,776,928 discloses an edge strip protector configuration of the above-mentioned type. This specification illustrates a U-shaped channel section adapted to fit generally around the edge zone of the electrode plate to be protected, where the U-section is made from a relatively rigid plastics material and the tip or free edges of the arms of the U-section are made from a more resilient plastics material that is co-extruded with the rigid plastics material to form the desired channel section. The resilient lips of the channel section are intended to provide a seal on the electrode plate whereby the edge zones of the plate will not have metal deposited thereon. U.S. Pat. No. 5,549,801 also discloses a similar edge strip protector having a U-shaped configuration with spaced arms of relatively rigid plastics material joined by a hinge portion of more resilient plastics material. Free ends of the spaced arms also carry seal pads of relatively resilient material such that the rigid plastics material and the resilient plastic material hinge and seal pads are co-extruded in a single manufacturing stage. The seal pads may be urged towards one another in use against an electrode plate by a suitable separate wedging member to provide an increased sealing force against the electrode past edge zones.

While the aforementioned arrangements are used and work satisfactorily for a period of time, it has been found that the resilient lips or sealing pads will quickly harden upon exposure to electrolyte solution and heat, and consequently may delaminate from the rigid plastics material of the protector strips. Moreover, a co-extrusion process of production does have certain disadvantages in that the plastics material used for the resilient portions must be compatible or have similar properties to that of the more rigid portions of the protector strip. This severely limits the range of materials that can be employed in the co-extrusion process.

SUMMARY OF THE INVENTION

The objective of the present invention is to provide a novel electrode plate edge zone protector strip which will overcome or minimise at least some of the aforementioned difficulties with the prior art arrangements.

Accordingly, the present invention provides a protector strip for an edge zone of an electrode plate, said protector strip including a first channel shaped member of relatively resilient material adapted, in use, to engage over the edge zone of the electrode plate, and a second channel shaped member of relatively more rigid material separate to said first channel shaped member adapted, in use to engage over the first channel shaped member to press at least a portion of said first channel shaped member into sealing engagement with the edge zone of the electrode plate.

Preferably said first channel shaped member has a pair of generally parallel legs and a base web joining said legs at one end. At or adjacent each free end of said legs is an inwardly directed projection or thickening adapted in use to provide a primary seal against the edge zone of the electrode plate. Conveniently, at or adjacent each said free end of said legs is a flange portion extending outwardly from the legs or oppositely to said inwardly directed projection or thickening. Preferably the second channel shaped member includes an inner groove formation extending there along, said groove formation having a depth equal to or greater than the depth of the first channel shaped member. Conveniently when the first channel shaped member is fully inserted into the groove formation of the second channel shaped member, a space exists between the base wall of the first channel shaped member and a base surface of the groove formation in the second channel shaped member.

In a further preferred arrangement, the second channel shaped members may be formed from channel shaped sections connected by joint means, the joint means enabling a said channel shaped section to be selectively removed laterally from an assembly of a plurality of such sections but preventing substantial movement relative to adjacent said sections longitudinally of the protector strip.

By providing an arrangement as aforesaid, the present invention is not reliant upon a chemical bond between rigid and resilient components thereby eliminating the risk of delamination while maintaining an effective and long term seal of the edge zone of the electrode plate. Moreover, since co-extrusion is not required, and more particularly at least the outer or second channel shaped member sections can be produced by injection moulding techniques, it is possible to use a much larger and more effective range of thermoplastic and thermoset materials for the component parts of the edge protector strip.

In accordance with a further aspect of the present invention, there is provided a protector strip for an edge zone of an electrode plate, said protector strip being formed by modular sections adapted to be successively joined by a joint arrangement, each said modular section having a channel shaped formation defining an inner groove adapted in use to fit over the edge zone of the electrode plate, said joint arrangement permitting one or more of said modular sections to be removed and replaced without needing to replace all of the protector strip. Such an arrangement has the significant advantage that should localised mechanical damage occur to the protector strip, only the damaged portion can be removed and replaced.

Conveniently the joint arrangement is integrally formed with the modular sections and prevents longitudinal movement between adjacent said modular sections but allows one or more said modular sections to be moved laterally from the protector strip. Preferably the joint arrangement comprises a male-female interlock.

BRIEF DESCRIPTION OF THE DRAWINGS

One preferred embodiment of the present invention will hereinafter be described with reference to the accompanying drawings, in which.

DETAILED DESCRIPTION OF THE INVENTION

Figure 1:
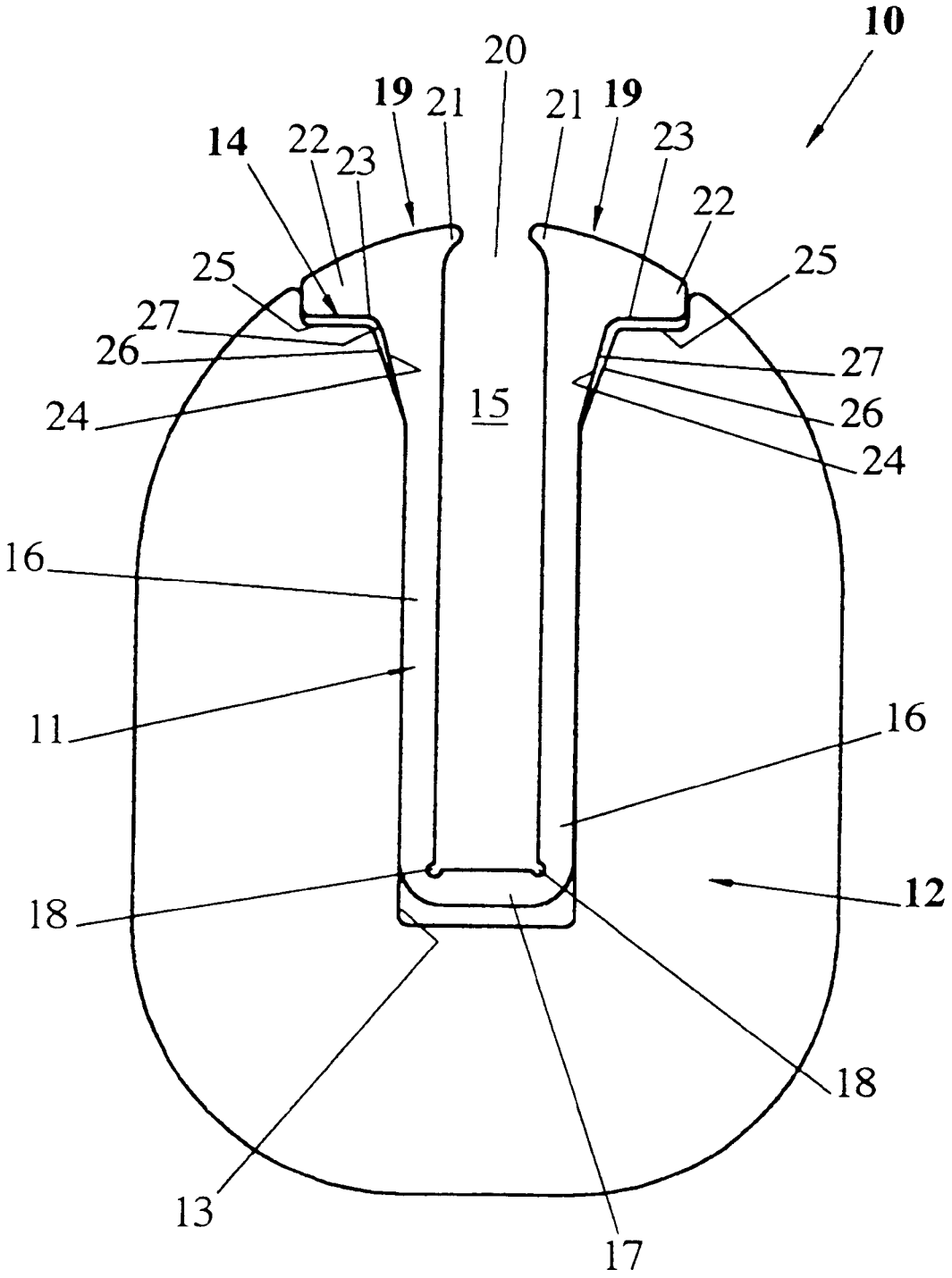
FIG. 1 is a cross-sectional drawing of a protector strip according to the present invention.
Figure 2:
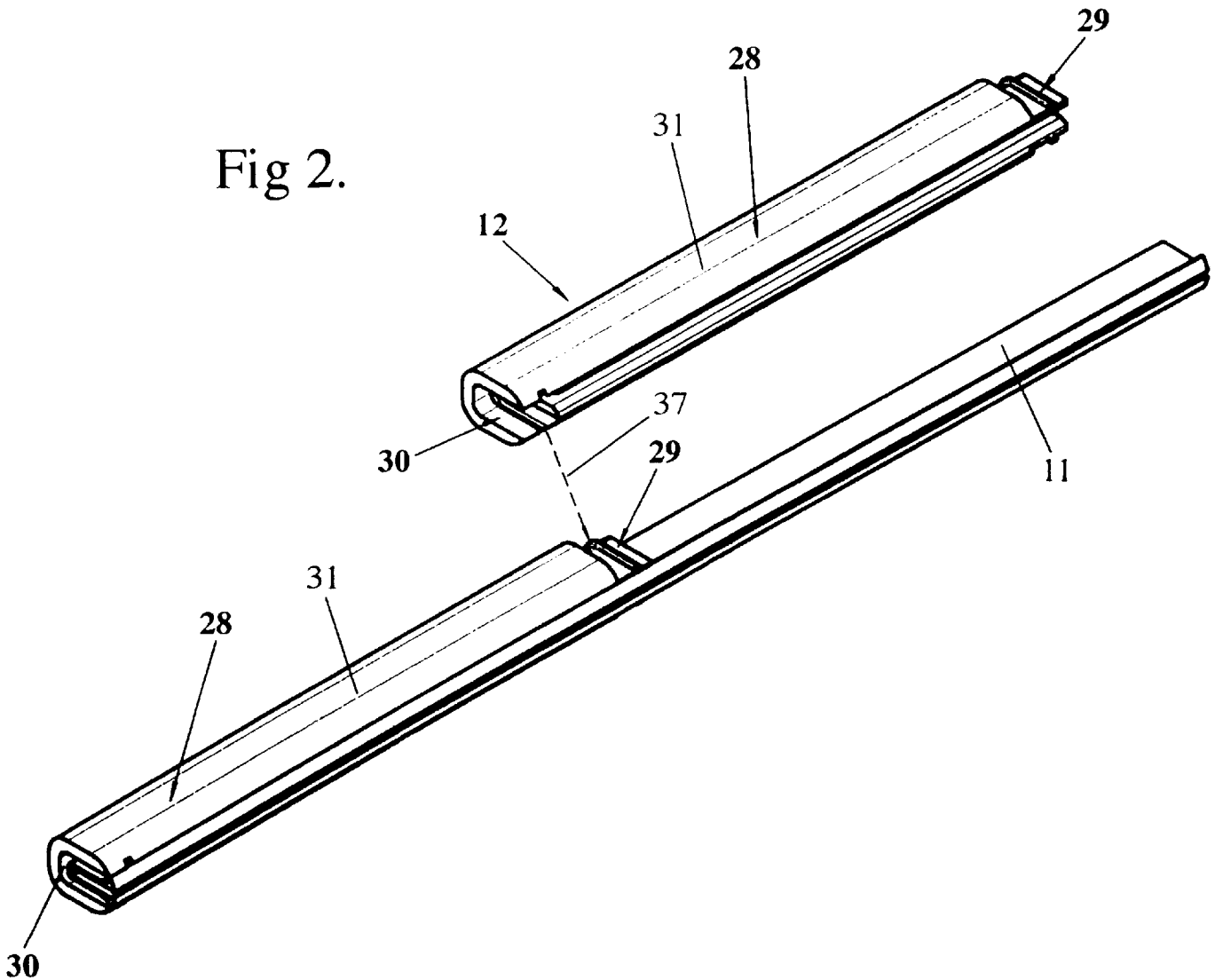
FIG. 2 is a perspective view illustrating the assembly of the protector strip of the present invention.

Referring to the annexed drawings there is shown in FIG. 1, a protector strip 10 comprised of a first channel shaped member 11 formed from a relatively resilient elastomeric material suitable for use in the environment of an electrolytic cell. A second channel shaped member 12 of a relatively more rigid plastics material adapted also for use in the environment of an electrolytic cell is also provided with an internal groove formation 13 having an open face 14. The first channel shaped member 11 is adapted to fit in the groove formation 13 and the member 11 provides an internal space 15 adapted, in use, to fit over an edge zone of the electrode (cathode) plate desired to be protected against unwanted deposition of metal. The first channel shaped member 11 has a pair of spaced legs 16 connected at one end by a base web 17 preferably with relief grooves 18 formed at the internal corners between the legs 16 and base web 17. At the other or outer ends 19 of the legs 16, an open face 20 is provided with projecting portions 21 directed inwardly across the open face 20 to provide sealing portions when an electrode plate edge zone is introduced into the space 15. The outer ends 19 of the legs 16 also have outwardly directed flange portions 22 which provide the member 11 with an inverted top hat cross-sectional appearance. Conveniently the inwardly facing surfaces 23 of the flange portions 22 and the outwardly facing surfaces 24 of the legs 16 adjacent the flange portions 22 are generally shaped complementary to adjacent surfaces 25 and 26 of the inner groove formation 13 but, in a free state as shown in FIG. 1, spaced a short distance therefrom. Preferably the surfaces 24 diverge outwardly at a slightly smaller angle to that of surfaces 26 whereby a diverging space 27 is formed between the two surfaces.

The remaining FIGS. 2 to 5 show in perspective view the configuration of the components shown in FIG. 1 in cross-sectional view. The inner first channel shaped member 11 is preferably of continuous length equivalent to the length of the electrode plate edge zone to be protected. It is, however, possible to form the member 11 in two or more lengths butting adjacent ends of such lengths together so long as the adjacent ends do not correspond to the joint arrangement between the sections of the outer members 12 as described herein after.

The second or outer channel shaped member 12, may as shown, be formed by modular sections 28, each of which may be formed by injection moulding of a suitable plastics material. Each modular section 28 has jointing formations 29,30 at opposed ends and a central section 31 joining the opposed ends that in cross-section is generally as shown in FIG. 1. The joint formation 29 is a male formation adapted to engage with a female joint formation 30 whereby when a plurality of such modular sections 28 are joined together as shown by indicator arrow 37, and a continuous outer channel section 12 is formed.

Figures 3, 4:
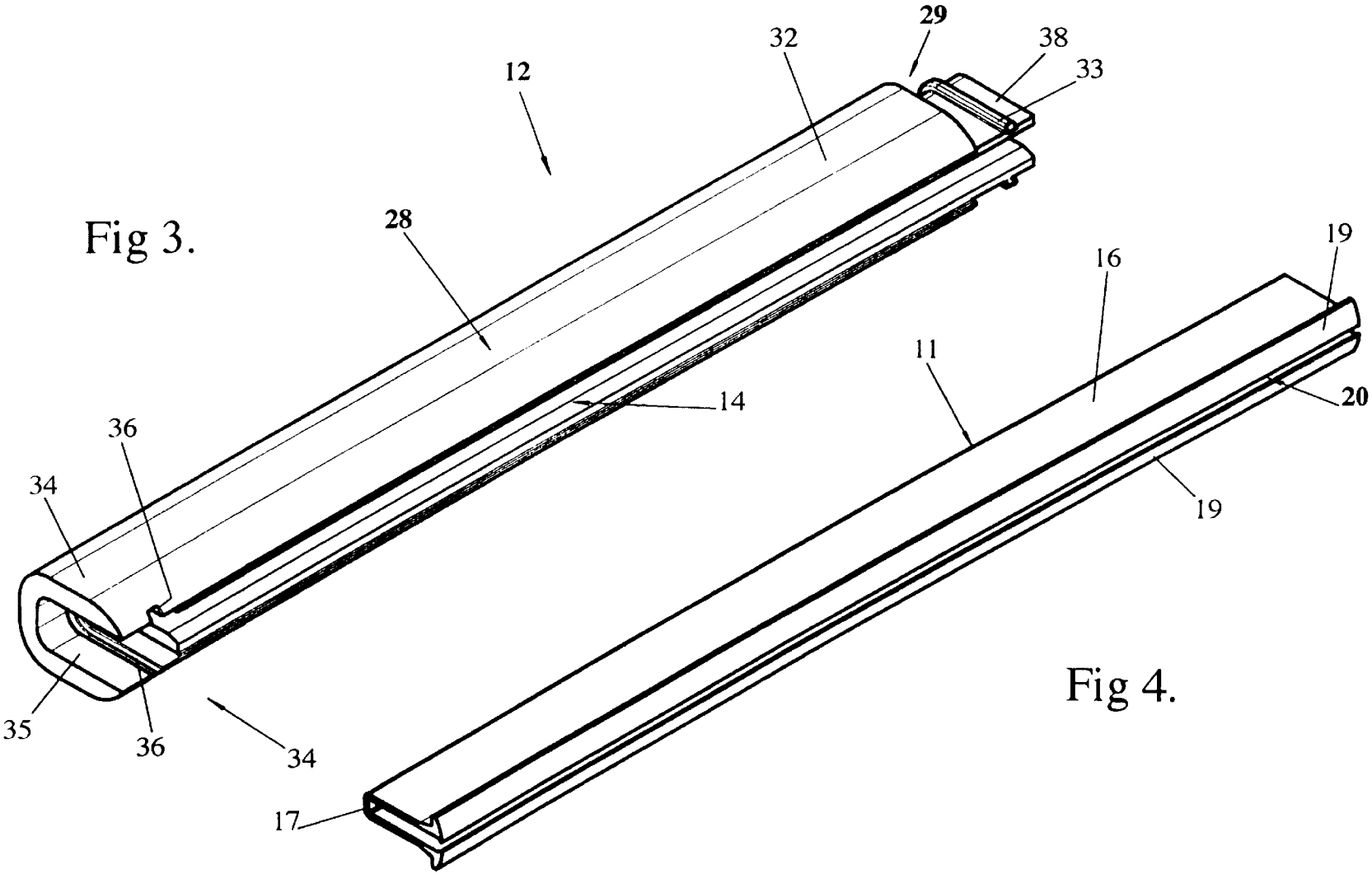
FIG. 3 is a perspective view showing one modular section and detail views of the preferred joint arrangement.
FIG. 4 is a perspective view showing the preferred inner resilient channel shaped member.

Referring particularly to FIG. 3, the joint formation 29 provides a U-shaped outer surface 38 of reduced dimension relative to the remainder of the outer surface 32 of the modular section 28. The surface 38 has an outwardly projecting rib 33 around its surface located in a transverse plane. The joint formation 30 has an outer surface 34 continuous with the surface 32 but an inner U-shaped surface 35 complementary in configuration to the surface 38 of the joint formation 29. This inner U-shaped surface 35 has a continuous recess 36 also located in a transverse plane whereby the rib 33 is engageable in the recess 36 only when the joint formation 30 is moved in the direction of arrow 37 (FIG. 2) to engage over the joint formation 29. When fully engaged, the modular sections cannot be separated or otherwise moved in a longitudinal direction but can only be separated (moved) in a lateral direction coincident with the transverse planes of the rib 33 and recess 36. Once assembled and positioned in use outward pressure created by the resilient channel member 11 captured between the channel shaped member 12 and the edge zone of the electrode panel being protected, prevents the modular sections 28 from unintentionally separating. However, if one or more sections 28 are damaged during mechanical handling, such sections are easily replaced without having to replace the complete edge protector strip.

Figure 5:
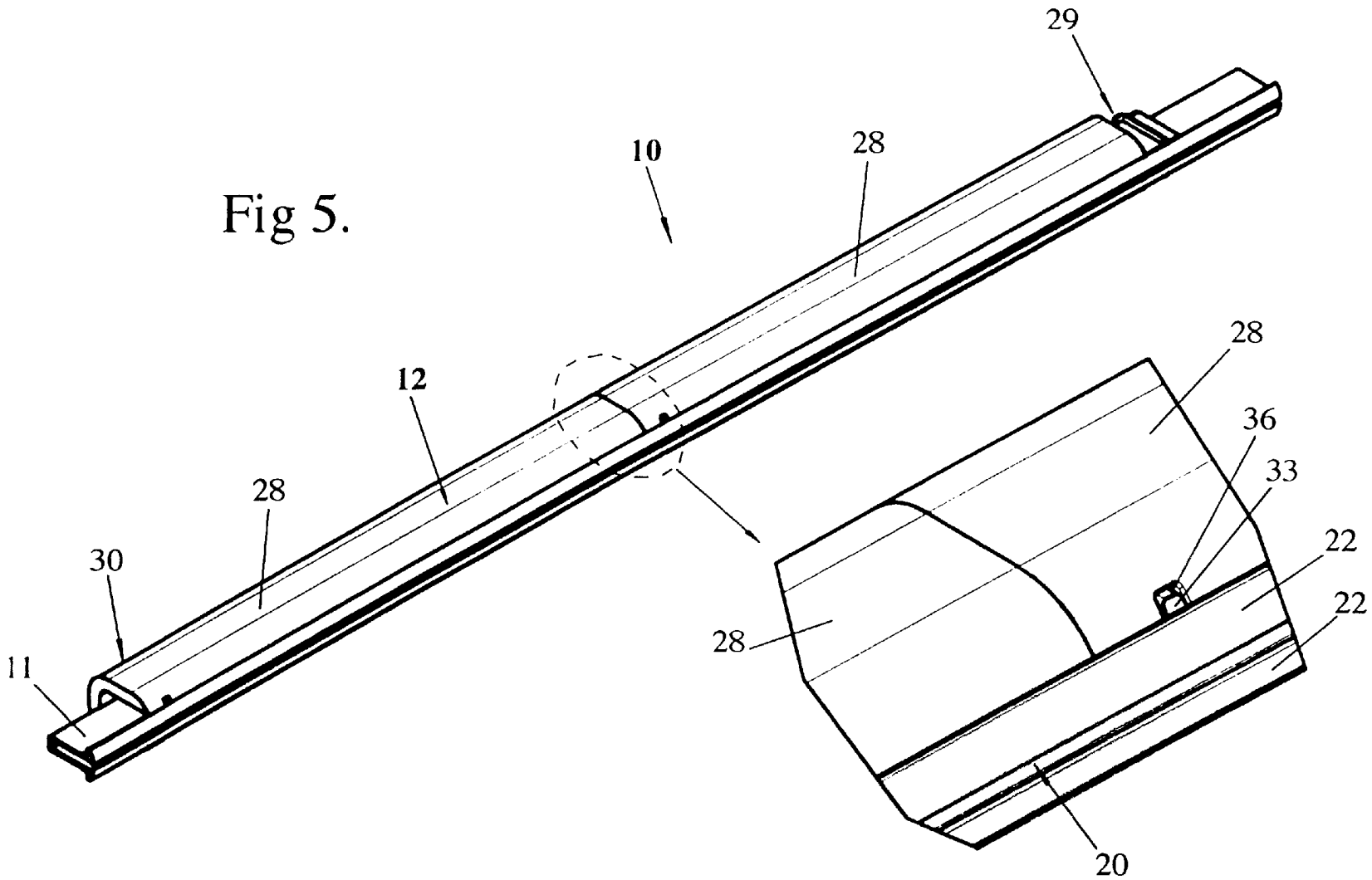
FIG. 5 is a perspective view showing an assembled protector strip construction.

FIG. 5 shows an example of an assembly of two modular sections 28 with a channel shaped member 11. An enlarged portion of the assembly showing the joint between the two modular sections is also shown. As can be seen, rib 33 fits within recess 36 to ensure that relative longitudinal movement between the two modular sections 28 is limited.

Figure 6:
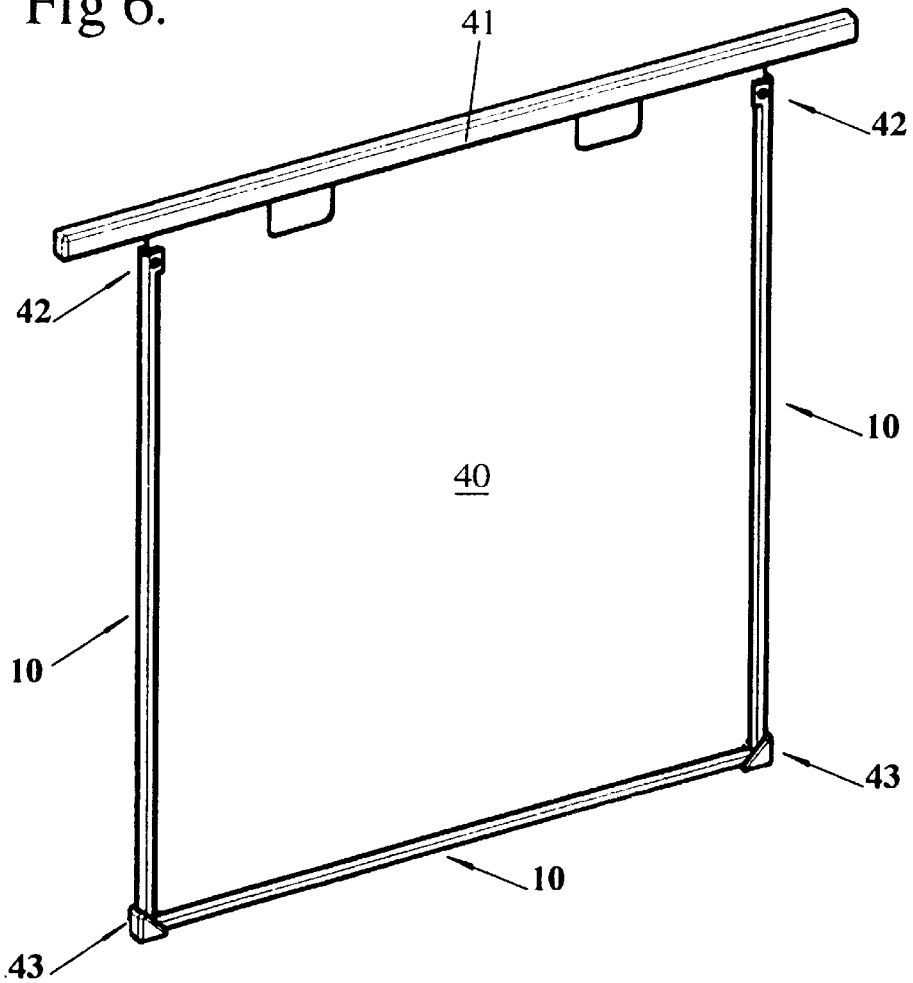
FIG. 6 is a perspective view of a cathode assembly incorporating the protector strip of the present in an assembled configuration.

FIG. 6 shows an assembled cathode plate 40 having protector strip sections 10 along three of the edges. The upper edge of the cathode plate 40 is attached to supporting member 41 from which the assembly depends. The assembly also includes two end attachment sections 42, and two corner assemblies 43.

Figure 7:
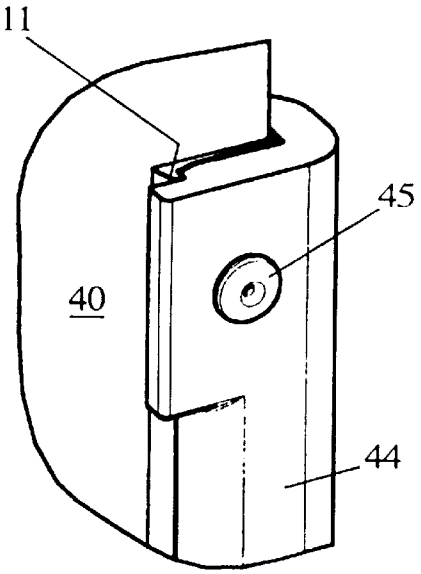
FIG. 7 is a perspective view of an end portion of a modular section of a protector strip in accordance with the present invention, constructed to allow additional fixing means for attaching the protector strip to the cathode plate.

An end attachment section 42 is shown in more detail in FIG. 7. The purpose of the end attachment section is to reduce the possibility of undesired removal of the protector strip 10 during operation. An end modular portion 44 operates in a similar manner to the earlier described modular portions 28, but is specially configured to provide for attachment of the protector strip 10 to the cathode plate 40. A rivet 45 or similar device is provided to attach the protector strip 10 to the cathode plate 40.

Figure 8:
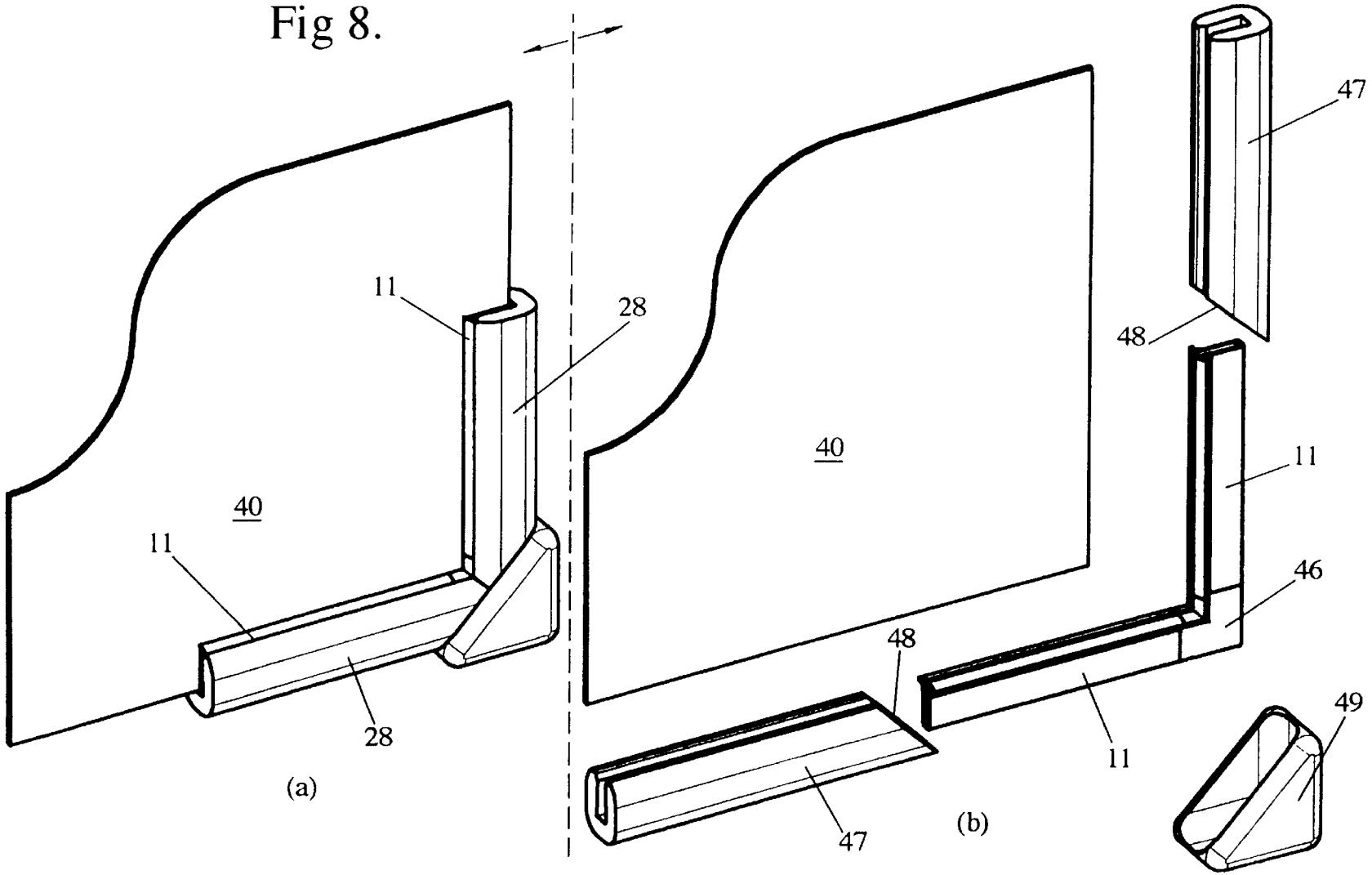
FIG. 8 is a perspective view in (a) assembled and (b) exploded configurations of a corner section of a protector strip in accordance with the invention.

A corner assembly 43 is shown in more detail in FIG. 8. FIG. 8(*a*) shows an assembled view, whilst FIG. 8(*b*) shows an exploded view. As can be seen from the exploded view, the assembly includes portions of channel shaped member 11 in accordance with the earlier description and an inner corner channel shaped member 46 which fits snugly adjacent the channel shaped member portions 11 and over the corner portion of the cathode plate 40. Specially configured corner modular portions 47 are provided to fit over the channel members 11 and 46 in the manner described in relation to the modular portions 28 in the above description. The angled portions 48 of the corner modular portions 47 fit snugly adjacent each other when assembled as shown in FIG. 8(*a*). A corner cover portion 49 is provided to fit over the corner as shown to provide additional protection to the assembly.

The claims defining the invention are as follows:

1. A protector strip for an edge zone of an electrode plate, said protector strip including:

a first channel shaped member of relatively resilient material adapted, in use, to engage over the edge zone of the electrode plate; and a second channel shaped member of relatively more rigid material separate to said first channel shaped member adapted, in use, to engage over the first channel shaped member to press at least a portion of said first channel shaped member into sealing engagement with the edge zone of the electrode plate.

2. A protector strip as claimed in claim 1, wherein said first channel shaped member has a pair of generally parallel legs and a base web joining said legs at one end.

3. A protector strip as claimed in claim 2, wherein at or adjacent each free end of said legs is an inwardly directed projection of thickening adapted in use to provide a primary seal against the edge zone of the electrode plate.

4. A protector strip as claimed in claim 3, wherein at or adjacent each said free end of said legs is a flange portion extending outwardly from the legs or oppositely to said inwardly directed projection or thickening.

5. A protector strip as claimed in claim 1, wherein the second channel shaped member includes an inner groove formation extending there along, said groove formation having a depth equal to or greater than the depth of the first channel shaped member.

6. A protector strip as claimed in claim 5, wherein when the first channel shaped member is fully inserted into the groove formation of the second channel shaped member, a space exists between the base wall of the first channel shaped member and a base surface of the groove formation in the second channel shaped member.

7. A protector strip in accordance with claim 1, wherein the second channel shaped members may be formed from channel shaped sections connected by joint means, the joint means enabling a said channel shaped section to be selectively removed laterally from an assembly of a plurality of such sections but preventing substantial movement relative to adjacent said sections longitudinally of the protector strip.

8. A protector strip for an edge zone of an electrode plate, said protector strip being formed by modular sections adapted to be successively joined by a joint arrangement, each said modular section having a channel shaped formation defining an inner groove adapted in use to fit over the edge zone of the electrode plate, said joint arrangement permitting one or more of said modular sections to be removed and replaced without needing to replace all of the protector strip.

9. A protector strip as claimed in claim 8, wherein the joint arrangement is integrally formed with the modular sections and prevents longitudinal movement between adjacent said modular sections but allows one or more said modular sections to be moved laterally from the protector strip.

10. A protector strip as claimed in one of claims 8 or 9, wherein the joint arrangement comprises a male-female interlock.

11. A protector strip for an edge zone of an electrode plate, said protector strip including:

a first channel shaped member of relatively resilient material having a pair of generally parallel legs and a base web joining said legs at one end to engage over the edge zone of the electrode plate, said legs having at or adjacent each free end, an inwardly directed projection or thickening to provide a primary seal against the edge zone of the electrode plate, each said free end of said legs further including a flange portion extending outwardly from the legs or oppositely to said inwardly directed projection or thickening; and a second channel shaped member of relatively more rigid material separate to said first channel shaped member to engage over the first channel shaped member to press at least a portion of said first channel shaped member into sealing engagement with the edge zone of the electrode plate.

12. A protector strip as claimed in claim 11, wherein the second channel shaped member includes an inner groove formation extending there along, said groove formation having a depth equal to or greater than the depth of the first channel shaped member.

13. A protector strip as claimed in claim 12, wherein when the first channel shaped member is fully inserted into the groove formation of the second channel shaped member, a space exists between the base wall of the first channel shaped member and a base surface of the groove formation in the second channel shaped member.

14. A protector strip in accordance with claim 11, wherein the second channel shaped members may be formed from channel shaped sections connected by joint means, the joint means enabling a said channel shaped section to be selectively removed laterally from an assembly of a plurality of such sections but preventing substantial movement relative to adjacent said sections longitudinally of the protector strip.

15. A protector strip for an edge zone of an electrode plate, said protector strip including:

a first channel shaped member of relatively resilient material to engage over the edge zone of the electrode plate; and a second channel shaped member of relatively more rigid material separate to said first channel shaped member to engage over the first channel shaped member to press at least a portion of said first channel shaped member into sealing engagement with the edge zone of the electrode plate, said second channel shaped member includes an inner groove formation extending there along, said groove formation having a depth equal to or greater than the depth of the first channel shaped member whereby, when the first channel shaped member is fully inserted into the groove formation of the second channel shaped member, a space exists between the base wall of the first channel shaped member and a base surface of the groove formation in the second channel shaped member.

16. A protector strip as claimed in claim 15, wherein said first channel shaped member has a pair of generally parallel legs and a base web joining said legs at one end.

17. A protector strip as claimed in claim 16, wherein at or adjacent each free end of said legs is an inwardly directed projection or thickening to provide a primary seal against the edge zone of the electrode plate.

18. A protector strip as claimed in claim 17, wherein at or adjacent each said free end of said legs is a flange portion extending outwardly from the legs or oppositely to said inwardly directed projection or thickening.

19. A protector strip in accordance with claim 15, wherein the second channel shaped members may be formed from channel shaped sections connected by joint means, the joint means enabling a said channel shaped section to be selectively removed laterally from an assembly of a plurality of such sections but preventing substantial movement relative to adjacent said sections longitudinally of the protector strip.

20. A protector strip for an edge zone of an electrode plate, said protector strip including:

a first channel shaped member of relatively resilient material to engage over the edge zone of the electrode plate; and a second channel shaped member of relatively more rigid material separate to said first channel shaped member to engage over the first channel shaped member to press at least a portion of said first channel shaped member into sealing engagement with the edge zone of the electrode plate, said second channel shaped member being formed from channel shaped sections connected by joint means, the joint means enabling a said channel shaped section to be selectively removed laterally from an assembly of a plurality of such sections but preventing substantial movement relative to adjacent said sections longitudinally of the protector strip.

21. A protector strip as claimed in claim 20, wherein said first channel shaped member has a pair of generally parallel legs and a base web joining said legs at one end.

22. A protector strip as claimed in claim 21, wherein at or adjacent each free end of said legs is an inwardly directed projection or thickening to provide a primary seal against the edge zone of the electrode plate.

23. A protector strip as claimed in claim 22, wherein at or adjacent each said free end of said legs is a flange portion extending outwardly from the legs or oppositely to said inwardly directed projection or thickening.

24. A protector strip as claimed in claim 20, wherein the second channel shaped member includes an inner groove formation extending there along, said groove formation having a depth equal to or greater than the depth of the first channel shaped member.

25. A protector strip as claimed in claim 24, wherein when the first channel shaped member is fully inserted into the groove formation of the second channel shaped member, a space exists between the base wall of the first channel shaped member and a base surface of the groove formation in the second channel shaped member.

* * * * *